US010452002B2

(12) United States Patent
Fujiwara et al.

(10) Patent No.: US 10,452,002 B2
(45) Date of Patent: Oct. 22, 2019

(54) DEVELOPING DEVICE

(71) Applicant: CANON KABUSHIKI KAISHA, Tokyo (JP)

(72) Inventors: Akihiro Fujiwara, Mishima (JP); Naoki Maeda, Suntou-gun (JP); Daisuke Makiguchi, Izunokuni (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/142,632

(22) Filed: Sep. 26, 2018

(65) Prior Publication Data

US 2019/0101851 A1 Apr. 4, 2019

(30) Foreign Application Priority Data

Oct. 3, 2017 (JP) ..... 2017-193780

(51) Int. Cl.
*G03G 15/08* (2006.01)

(52) U.S. Cl.
CPC ..... *G03G 15/0898* (2013.01); *G03G 15/0812* (2013.01)

(58) Field of Classification Search
CPC ..... G03G 15/0898; G03G 15/0812
See application file for complete search history.

(56) References Cited

U.S. PATENT DOCUMENTS

2008/0240770 A1* 10/2008 Mimura ..... G03G 15/0815 399/103
2014/0072326 A1* 3/2014 Yamaguchi ..... G03G 21/0011 399/102
2018/0284648 A1* 10/2018 Fukatsu ..... G03G 15/0812

FOREIGN PATENT DOCUMENTS

JP 62-1492 Y2 1/1987
JP 2001125465 A * 5/2001
JP 2002-207409 A 7/2002
JP 2006079025 A * 3/2006
JP 2007286485 A * 11/2007
JP 4612770 B2 1/2011
JP 2012-118566 A 6/2012
JP 5326726 B2 10/2013
JP 2014089244 A * 5/2014 ..... G03G 21/181

* cited by examiner

*Primary Examiner* — Sevan A Aydin
(74) *Attorney, Agent, or Firm* — Canon U.S.A., Inc. IP Division

(57) ABSTRACT

A developing device includes a rotatable developer bearing member, a regulation member configured to regulate a thickness of the developer borne on the surface of the developer bearing member, a frame configured to support the developer bearing member, the frame including a recess in an opposed surface opposed to the regulation member, the recess being recessed in a direction away from the regulation member and extending from a center portion toward both end portions in the rotation axis direction, a width, in the orthogonal direction, of the recess in both the end portions increasing gradually as distance from the center portion in the rotation axis direction increases, and a sealing member provided in the recess to seal a gap between the regulation member and the frame, the sealing member being formed by ejecting thermally molted resin into the recess.

10 Claims, 8 Drawing Sheets

DEVELOPING DEVICE

BACKGROUND OF THE INVENTION

Field of the Invention

The disclosure relates to developing devices used in electrophotographic image forming apparatuses.

Description of the Related Art

In an image forming apparatus, an electrophotographic photosensitive member serving as an image bearing member and typically has a drum shape, i.e., a photosensitive drum is uniformly charged. The charged photosensitive drum is then selectively exposed to form an electrostatic latent image (electrostatic image) on the photosensitive drum. Next, the electrostatic latent image formed on the photosensitive dram is developed into a toner image by toner. The toner image formed on the photosensitive drum is then transferred to a recording material such as a recording sheet and a plastic sheet. Heat and pressure are further applied to the toner image transferred onto the recording material, whereby the toner image is fixed to the recording material. In this way, image recording is performed.

Such an image forming apparatus typically needs toner replenishment and maintenance of various process means. To facilitate the toner replenishment and maintenance, a process cartridge attachable to and detachable from an image forming apparatus main body has been put to practical use. The photosensitive drum, a charging unit, a developing unit, and a cleaning unit are integrated in a frame to form the process cartridge.

According to such a process cartridge system, the maintenance of the image forming apparatus can be performed by the user. This can significantly improve operability, and enables provision of an image forming apparatus having excellent usability. The process cartridge system is thus widely used in image forming apparatuses.

The process cartridge and the developing unit include, as developing means, a developer bearing member (developing roller) and a thickness regulation member (developing blade) in a developing container. The developing roller bears and conveys toner. The developing blade regulates the thickness of the toner on the developing roller. A plurality of sealing members is used for the purpose of sealing so that the toner accommodated in the developing container will not leak out of the developing unit via these members.

As an example of the sealing members, Japanese Patent Application Laid-Open No. 2012-118566 discusses end sealing members for preventing toner from flowing out of the developing region. The end sealing members are provided on both longitudinal ends of a rotatable developing roller. A blade sealing member for preventing the toner from flowing out is also provided between the end sealing members and both end portions of the developing blade. For example, the blade sealing member is made of an elastomer member having elasticity. The blade sealing member is known to be manufactured by applying a melted liquid material of hot melt resin to the developing container, and then curing it. The hot melt resin is applied to a seal forming portion of the developing container. The developing blade is assembled after the application of the hot melt resin, and the hot melt resin is cured in a compressed and deformed manner by the developing blade, whereby the gap between the developing container and the developing blade is sealed. For such a resin molding apparatus, one that can apply hot melt resin to a predetermined position by performing control to eject a constant amount of melted hot melt resin from a nozzle and moving the nozzle while ejecting the melted hot melt resin has been known.

To reduce the time of the process for applying the hot melt resin, the hot melt resin may be applied while moving the nozzle on a straight line from one end side to the other end side in a longitudinal direction. At both ends (i.e., an application start position and application end position of the hot melt resin), the moving speed of the nozzle becomes low due to acceleration and deceleration operations of the nozzle. The amount of application of the hot melt resin thus increases at both ends. Widening the shape of the seal forming portion at both ends (Japanese Patent No. 4612770) and broaden out the groove at each end toward thereto (Japanese Patent No. 5326726) have therefore been discussed.

Reduction in size of image forming apparatuses and, by extension, cartridges has been demanded in recent years. With the reduction in size of cartridges, it has become difficult to secure sufficient space in areas at both end of the seal forming portion. Since the space for retaining the hot melt resin is difficult to secure at both ends, the hot melt resin may run out from the area of the seal forming portion. If the hot melt resin runs out from the area of the seal forming portion, the blade sealing member fails to be shaped to protrude from the seal forming portion, and becomes small in height (thickness) compared to a blade sealing member that is formed without leakage of the hot melt resin. If the hot melt resin flows out of the area of the seal forming portion during manufacturing of the blade sealing member, the formed blade sealing member may therefore have an area not in contact with the developing blade assembled on the blade sealing member. If the hot melt resin flows out of the area of the seal forming portion during manufacturing, a gap may occur between the blade sealing member and the blade sealing member. Such a blade sealing member may be unable to sufficiently seal the gap between the developing blade and the developing container, and the toner may flow out.

SUMMARY OF THE INVENTION

According to an aspect of the disclosure, a developing device includes a rotatable developer bearing member configured to bear a developer on a surface, a regulation member configured to regulate a thickness of the developer borne on the surface of the developer bearing member, an end of the regulation member in a direction orthogonal to a rotation axis direction being in contact with the surface of the developer bearing member, a frame configured to support the developer bearing member, the other end of the regulation member in the orthogonal direction being fixed to the frame, the frame including a recess in an opposed surface opposed to the regulation member, the recess being recessed in a direction away from the regulation member and extending from a center portion toward both end portions in the rotation axis direction, a width, in the orthogonal direction, of the recess in both the end portions increasing gradually as distance from the center portion in the rotation axis direction increases, and a sealing member provided in the recess to seal a gap between the regulation member and the frame, the sealing member being formed by ejecting thermally melt resin into the recess.

According to another aspect of the disclosure, a frame used in a developing device including a rotatable developer bearing member configured to bear a developer on a surface, and a regulation member configured to regulate a thickness of the developer borne on the surface of the developer bearing member, an end of the regulation member in a direction orthogonal to a rotation axis direction being in contact with the surface of the developer bearing member, includes a recess in an opposed surface opposed to the regulation member, the recess being recessed in a direction away from the regulation member and extending from a center portion to both end portions in the rotation axis direction, a width, in the orthogonal direction, of the recess in both the end portions increasing gradually as distance from the center portion in the rotation axis direction increases, and a sealing member formed by ejecting thermally melted resin into the recess, the sealing member being configured to seal a gap between the regulation member and the frame.

Further features and aspects of the disclosure will become apparent from the following description of example embodiments with reference to the attached drawings.

DESCRIPTION OF THE EMBODIMENTS

As employed herein, an electrophotographic image forming apparatus (hereinafter, image forming apparatus) refers to an apparatus that forms an image on a recording medium by using an electrophotographic image forming method. Examples of the image forming apparatus include an electrophotographic copying machine, an electrophotographic printer (such as a light-emitting diode (LED) printer and a laser beam printer), a facsimile apparatus, and a word processor.

A developing device refers to a device that includes a developer bearing member for bearing developer and is detachably mounted on an apparatus main body of an image forming apparatus.

First Example Embodiment

Figure 2:
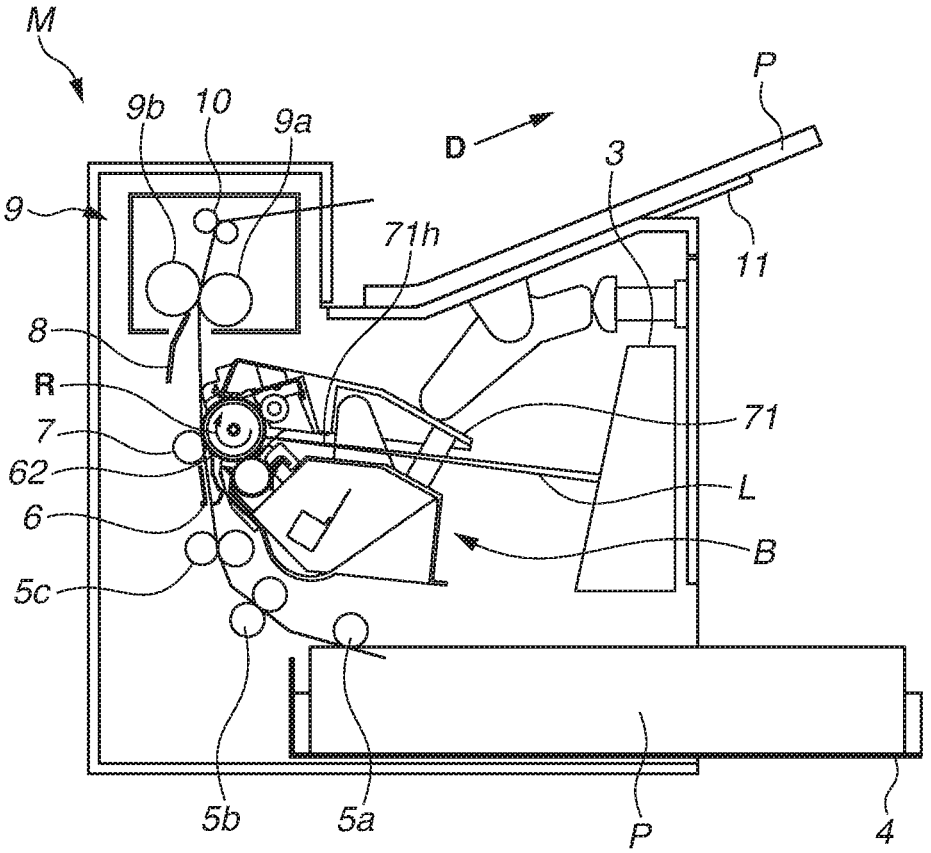
FIG. 2 is a sectional view of an image forming apparatus main body and a process cartridge of an electrophotographic image forming apparatus according to the first example embodiment.
Figure 3:
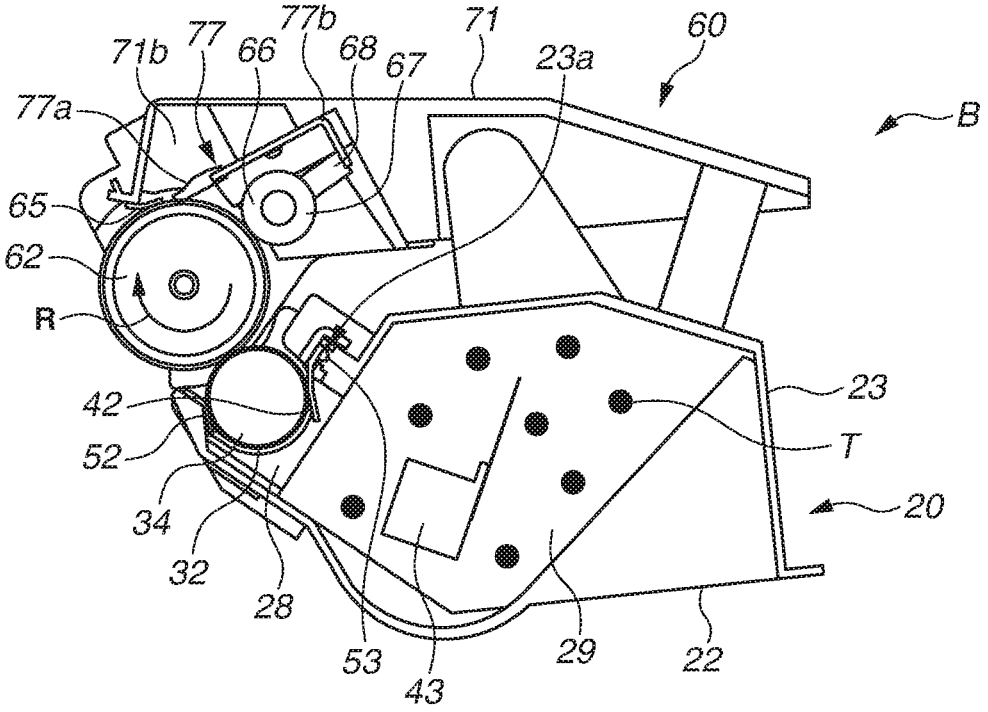
FIG. 3 is a sectional view of the process cartridge according to the first example embodiment.

A configuration according to a first example embodiment of the disclosure will be described in detail below with reference to the drawings. A rotation axis direction of an electrophotographic photosensitive drum will be referred to as a longitudinal direction. An overall configuration and an image forming process will be described with reference to FIGS. 2 and 3. FIG. 2 is a sectional view of an image forming apparatus main body (hereinafter, apparatus main body M) and a process cartridge (hereinafter, cartridge B) of an electrophotographic image forming apparatus according to an example embodiment of the disclosure. FIG. 3 is a sectional view of the cartridge B. As employed herein, the apparatus main body M refers to the electrophotographic image forming apparatus other than the cartridge B.

<Overall Configuration of Electrophotographic Image Forming Apparatus>

The electrophotographic image forming apparatus illustrated in FIG. 2 is a laser beam printer using an electrophotographic technology, with the cartridge B attachable to and detachable from the apparatus main body M. When the cartridge B is attached to the apparatus main body M, an exposure device (laser scanner unit) 3 is arranged to form a latent image on an electrophotographic photosensitive drum (hereinafter, drum) 62 of the cartridge B. The drum 62 serves as an image bearing member. A sheet tray 4 containing recording media (hereinafter, sheet materials P) for forming image thereon is arranged below the cartridge B. The apparatus main body M further includes a pickup roller 5*a*, a feed roller pair 5*b*, a conveyance roller pair 5*c*, a transfer guide 6, a transfer roller 7, a conveyance guide 8, a fixing device 9, and a discharge roller pair 10 which are arranged in order along a conveyance direction D of a sheet material P. The fixing device 9 includes a heating roller 9*a* and a pressure roller 9*b*.

<Image Forming Process>

Next, an outline of the image forming process will be described. The electrophotographic photosensitive drum 62 is driven to rotate in the direction of the arrow R (FIG. 3) at a predetermined circumferential speed (process speed) in response to a print start signal. A charging roller 66, to which a bias voltage supplied from a power supply (not illustrated) provided in the apparatus main body M is applied, comes into contact with the outer peripheral surface of the drum 62 and uniformly and evenly charges the outer peripheral surface of the drum 62. The exposure device 3 outputs laser light L according to image information. The laser light L passes through a laser opening 71*h* formed in a cleaning frame 71 of the cartridge B, and scans to expose the outer peripheral surface of the drum 62 therewith. An electrostatic latent image corresponding to the image information is thereby formed on the outer peripheral surface of the drum 62.

Meanwhile, as illustrated in FIG. 3, in a developing unit 20 serving as a developing device, toner T in a toner chamber 29 is agitated and conveyed by rotation of a conveyance member 43 and delivered to a toner supply chamber 28. The toner T is borne on the surface of a developing roller 32 by magnetic force of a magnet roller (stationary magnet) 34. The toner T is frictionally charged by a developing blade (thickness regulation member) 42 while being regulated in thickness on the peripheral surface of the developing roller 32 serving as a developer bearing member. The toner T is applied onto the drum 62 according to the electrostatic latent image, and thus the electrostatic latent image is visualized as a toner image.

As illustrated in FIG. 2, a sheet material P stored in the lower part of the apparatus main body M is fed out from the sheet tray 4 by the pickup roller 5*a*, the feed roller pair 5*b*, and the conveyance roller pair 5*c* in synchronization with the output timing of the laser light L. The sheet material P is then conveyed through the transfer guide 6 to a transfer position between the drum 62 and the transfer roller 7. At the transfer position, the toner image is sequentially transferred from the drum 62 to the sheet material P. The sheet material P to which the toner image is transferred is separated from the drum 62 and conveyed to the fixing device 9 along the conveyance guide 8. The sheet material P then passes through a nip portion between the heating roller 9*a* and the pressure roller 9*b* constituting the fixing device 9. At the nip portion, the toner image is subjected to heat and pressure fixing processing and fixed to the sheet material P. The sheet material P subjected to the fixing processing of the toner image is conveyed to the discharge roller pair 10 and discharged to a discharge tray 11.

As illustrated in FIG. 3, after the transfer, residual toner on the outer peripheral surface of the drum 62 is removed by a cleaning member 77, and the drum 62 is used for an image forming process again. The toner removed from the drum 62 is stored in a waste toner chamber 71*b* of a cleaning unit 60 serving as a frame including the photosensitive drum 62.

In the foregoing description, the charging roller 66, the developing roller 32, the transfer roller 7, and the cleaning member 77 correspond to process unit acting on the drum 62.

<Configuration of Entire Cartridge>

Next, an overall configuration of the cartridge B will be described with reference to FIG. 3. FIG. 3 is a sectional view of the cartridge B.

The cartridge B includes the cleaning unit 60 and the developing unit (developing device) 20. In general, a process cartridge refers to a cartridge that integrally includes an electrophotographic photosensitive member and at least one of a charging unit, developing unit, and cleaning means serving as process unit acting thereon, and is configured to be attachable to and detachable from the main body of an electrophotographic image forming apparatus. The process cartridge includes at least the cleaning unit 60.

The cleaning unit 60 includes the drum 62, the charging roller 66, the cleaning member 77, and the cleaning frame 71 supporting the drum 62, the charging roller 66, and the cleaning member 77. In the cleaning unit 60, the charging roller 66 and the cleaning member 77 are both arranged in contact with the outer peripheral surface of the drum 62.

The cleaning member 77 includes a rubber blade 77*a*, which is a blade-shaped elastic member formed of rubber as an elastic material, and a support member 77*b*, which supports the rubber blade 77*a*. The rubber blade 77*a* makes contact with the drum 62 in a counter direction with respect to the rotation direction of the drum 62. More specifically, the rubber blade 77*a* is in contact with the drum 62 so that its tip portion is directed upstream in the rotation direction of the drum 62.

Waste toner removed from the surface of the drum 62 by the cleaning member 77 is stored in the waste toner chamber 71*b* which is formed by the cleaning frame 71 and the cleaning member 77.

A scooping sheet 65 for preventing leakage of the waste toner from the cleaning frame 71 is provided on an edge portion of the cleaning frame 71, in contact with the drum 62. By receiving driving force from a main body driving motor (not illustrated) serving as a driving source, the drum 62 is driven to rotate in the direction of the arrow R in FIG. 2 according to an image formation operation. The charging roller 66 is rotatably attached to the cleaning unit 60 via charging roller bearings 67 at both ends in the longitudinal direction (substantially parallel to the rotation axis direction of the drum 62) of the cleaning frame 71. The charging roller bearings 67 are pressed toward the drum 62 by biasing members 68, whereby the charging roller 66 is pressed against the drum 62. The charging roller 66 is driven to rotate by the rotation of the drum 62.

The developing unit 20 includes the developing roller (developer bearing member) 32, a developing container (developing frame) 23 that supports the developing roller 32, and the developing blade 42. A magnet roller 34 is provided inside the developing roller 32. The developing blade (regulation member) 42 for regulating the thickness of the toner layer on the developing roller 32 is arranged in the developing unit 20. The developing blade 42 extends in the rotation axis direction of the developing roller 32. The longitudinal direction of the developing roller 32 is therefore synonymous with the rotation axis direction. One end of the developing blade 42 in a direction orthogonal to the longitudinal direction of the developing roller 32 is in contact with the surface of the developing roller 32. The other end is fixed to the developing container 23. Spacer members (not illustrated) are attached to both end portions of the developing roller 32. The spacer members make contact with the drum 62 so that the developing roller 32 is maintained with a small gap from the drum 62. The developing container 23 further includes the toner chamber 29 formed by integrating a bottom member 22 with the container main body. The conveyance member 43 is arranged in the toner chamber 29. The conveyance member 43 agitates the toner T accommodated in the toner chamber 29, and conveys the toner T to the toner supply chamber 28.

<Toner Sealing Configuration of Developing Unit>

Figure 4A:
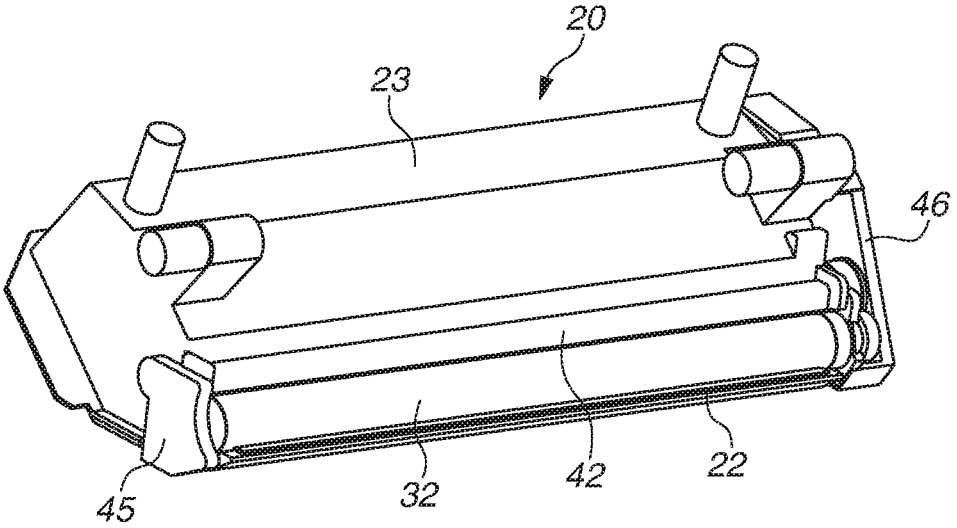
FIGS. 4A and 4B are perspective views of the developing unit according to the first example embodiment.
Figure 4B:
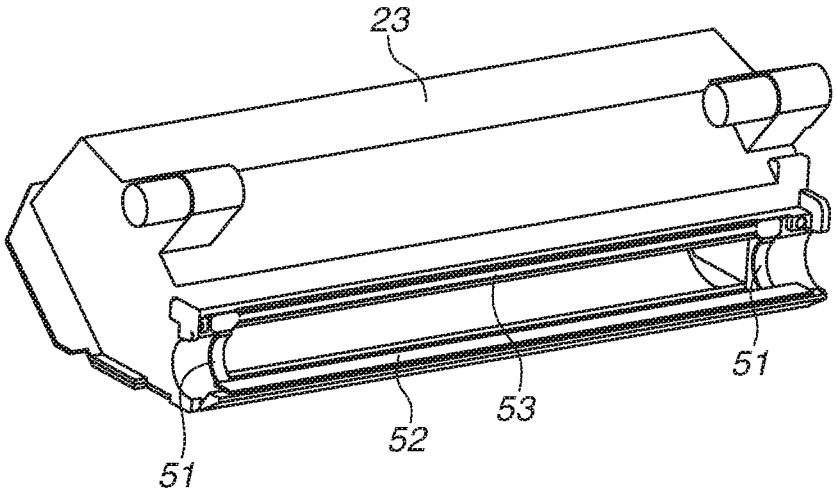

Next, a toner sealing configuration of the developing unit 20 will be described with reference to FIGS. 4A and 4B. FIG. 4A is a perspective view of the developing unit 20 to which the developing roller 32 is rotatable attached by bearing members 45 and 46. FIG. 4B is a perspective view of the developing unit 20 from which the bearing members 45 and 46, the developing roller 32, and the developing blade 42 are removed.

As illustrated in FIGS. 4A and 4B, to make close contact with the developing roller 32 and the developing blade 42 and seal the gaps to prevent toner leakage, end sealing members 51 are provided on the developing container 23 at both longitudinal ends of the developing roller 32 and the developing blade 42. To seal the gap between the rotationally-driven developing roller 32 and the bottom member 22 (developing container 23) to prevent toner leakage, a bleeding prevention sheet 52 is provided on the bottom member 22 (developing container 23). To seal the gap between the developing blade 42 and the developing container 23 to prevent toner leakage, a blade sealing member 53 is further provided on the developing container 23. The blade sealing member 53 makes contact with the end sealing members 51 and seals the gaps with the end sealing members 51.

In the present example embodiment, the blade sealing member 53 is made of hot melt resin. The blade sealing member 53 having elasticity is formed by melting the hot melt resin and applying the liquefied hot melt resin to the developing container 23, followed by curing.

The hot melt resin is a resin that melts when heated in the present example embodiment, thermoplastic elastomer resin is used. The blade sealing member 53 extends in the rotation axis direction of the developing roller 32.

<Forming Process of Blade Sealing Member>

Figure 1:
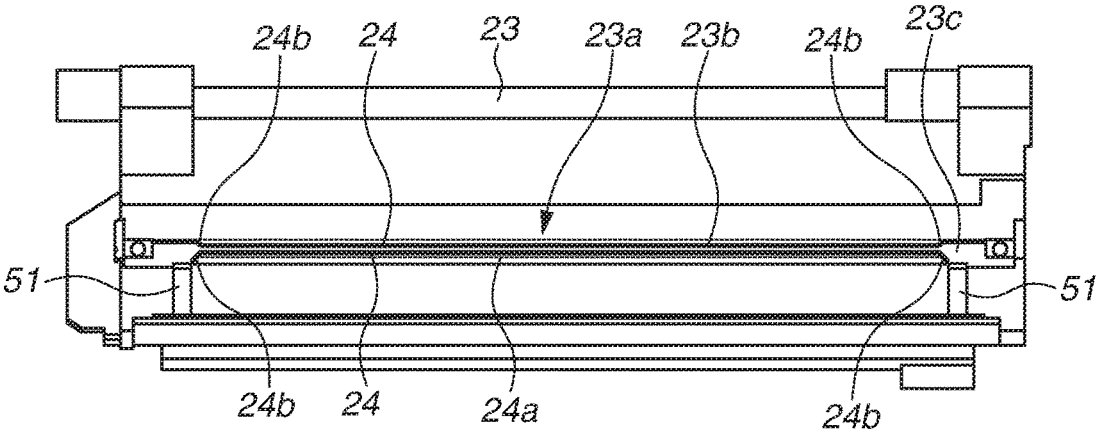
FIG. 1 is a diagram illustrating a configuration of a seal forming portion of a developing unit according to a first example embodiment.

Next, the forming process of the blade sealing member 53 will be described with reference to FIGS. 1, 5A, 5B, 5C, 6, 7, and 8. FIG. 1 is a diagram illustrating a configuration of a seal forming portion 23*a* of the developing container 23.

Figure 5A:
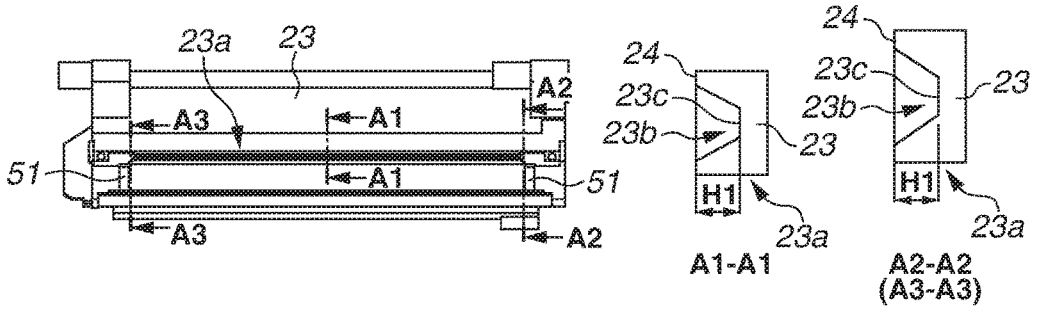
FIGS. 5A, 5B, and 5C are diagrams illustrating a configuration of the seal forming portion of the developing unit according to the first example embodiment.
Figure 5B:
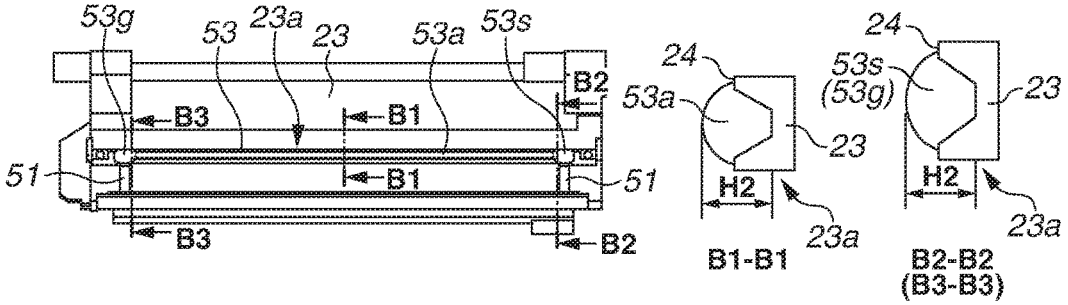
Figure 5C:
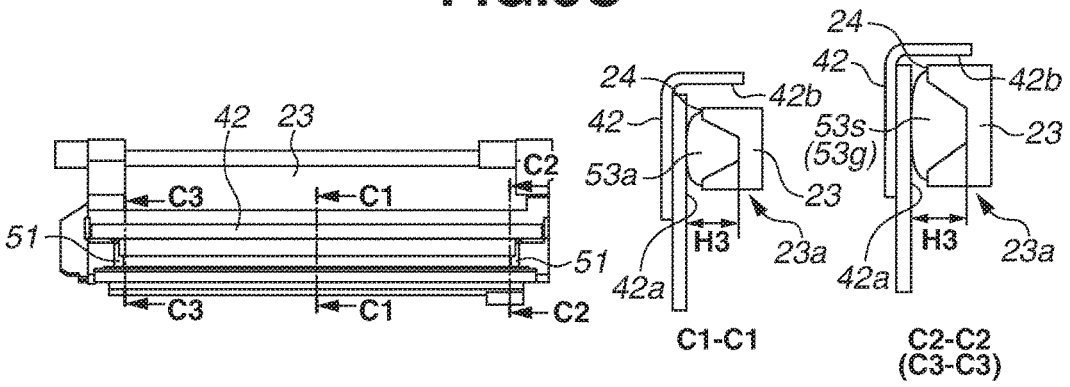
Figure 6:
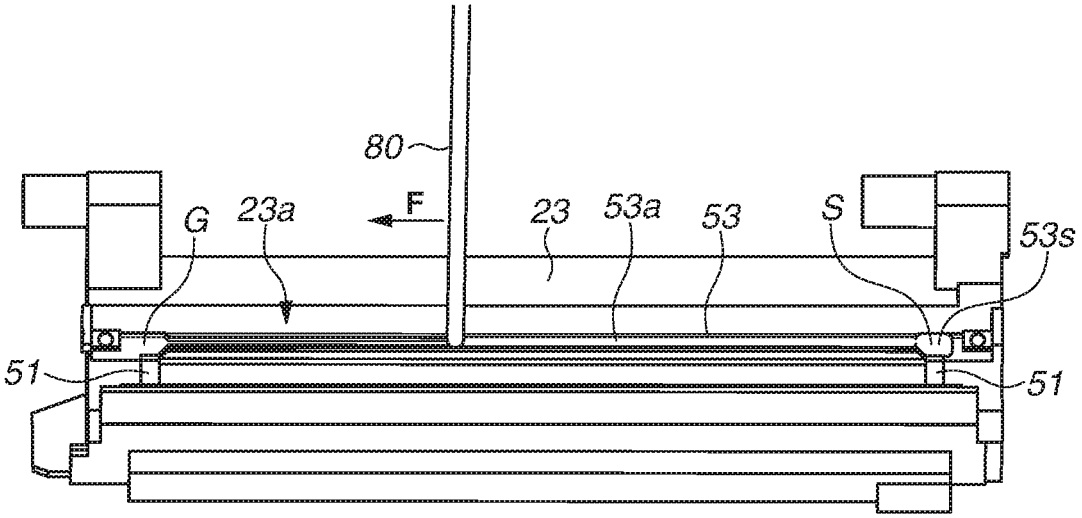
FIG. 6 is a diagram illustrating a configuration of the seal forming portion of the developing unit according to the first example embodiment.
Figure 7:
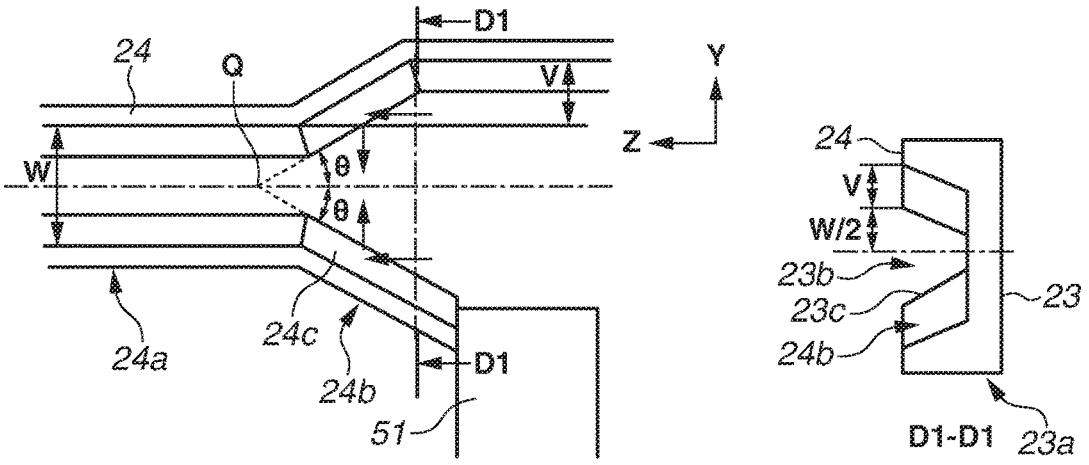
FIG. 7 is a diagram illustrating a configuration of the seal forming portion of the developing unit according to the first example embodiment.
Figure 8:
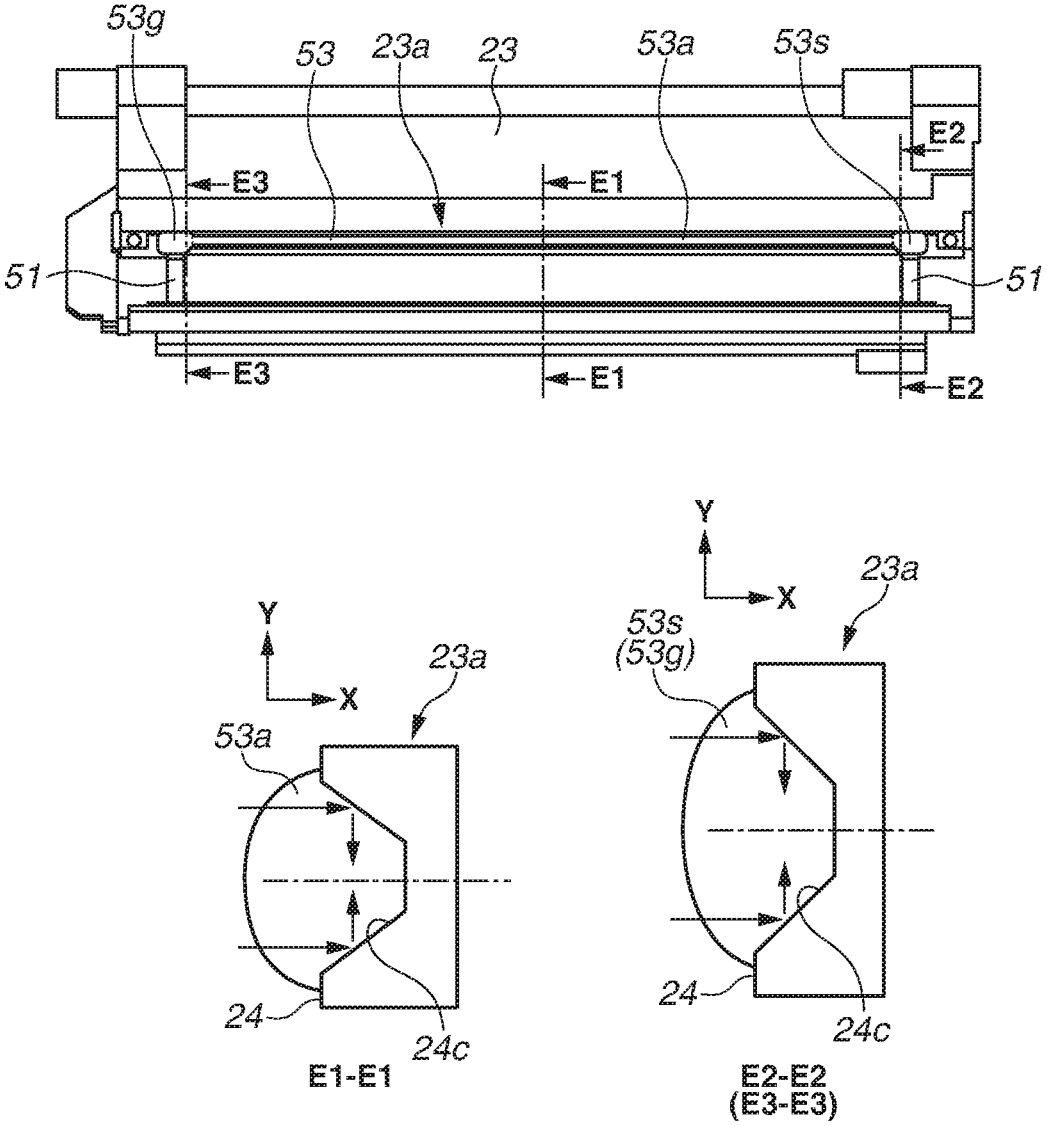
FIG. 8 is a diagram illustrating a configuration of the seal forming portion of the developing unit according to the first example embodiment.

FIG. 5A is a diagram illustrating the developing container 23 to which the end sealing members 51 are bonded. FIG. 5B is a diagram illustrating a state in which the liquefied hot melt resin is applied to the developing container 23. FIG. 5C is a diagram illustrating a state in which the developing blade 42 is attached after the application of the hot melt resin to the developing container 23. FIG. 6 is a diagram illustrating a state in which the liquefied hot melt resin is being applied to the developing container 23. FIGS. 7 and 8 are enlarged partial views illustrating the shape of the seal forming portion (recess) 23*a* formed in the developing container 23.

As illustrated in FIG. 6, the liquefied hot melt resin is ejected from the tip of a nozzle 80 and applied to the seal forming portion 23*a* of the developing container 23. The liquefied hot melt resin is ejected from the tip of the nozzle 80 by a constant amount per unit time. The tip of the nozzle 80 is directed downward in the gravitational direction. During the application of the hot melt resin, the developing container 23 is situated with the longitudinal direction of the seal forming portion 23*a* horizontal. The tip of the nozzle 80 is located at a position opposed to the seal forming portion 23*a*. The hot melt resin starts to be applied at an application start position S on one end side in the longitudinal direction, and is applied straight in the direction of the arrow F toward an application end position G on the other end side. This reduces the time of the application process. In this case, the nozzle 80 starts the ejection of the hot melt resin after the nozzle 80 is positioned above the application start position S. The ejection of the hot melt resin is stopped when the nozzle 80 reaches above the application end position G. In other words, the nozzle 80 starts to move from the stopped state above the application start position S, and enters the stopped state again above the application end position G. Since the amount of hot melt resin ejected from the tip of the nozzle 80 per unit time is constant, the amount of hot melt resin ejected into the seal forming portion 23*a* varies with the moving speed of the nozzle 80. Since the moving speed of the nozzle 80 is low at both longitudinal ends, the amount of hot melt resin on the seal forming portion 23*a* is greater in longitudinal end portions 53*s* and 53*g* than in a longitudinal center portion 53*a* as illustrated in FIG. 5B. In this case, the ejected hot melt resin makes close contact with the end sealing members 51 at both ends.

After the hot melt resin is applied as illustrated in FIG. 5B, the developing blade 42 is assembled from above the applied hot melt resin as illustrated in FIG. 5C. At that time, the developing blade 42 compresses and deforms the hot melt resin for close contact so that the hot melt resin functions as the blade sealing member 53 for sealing the gap between the developing container 23 and the developing blade 42.

<Configuration of Seal Forming Portion>

Next, a configuration of the seal forming portion 23*a* of the developing container 23 will be described. As illustrated in FIG. 1, the seal forming portion 23*a* includes a hot melt application surface 23*c*, regulation ribs 24, and a flow channel 23*b*. The regulation ribs 24 are protruded from an opposed surface opposed to the developing blade 42, including the hot melt application surface 23*c*. The flow channel 23*b* is formed by the two regulation ribs 24 opposed with the hot melt application surface 23*c* therebetween. In other words, the flow channel 23*b* is a recess formed by the two regulation ribs 24 opposing each other and the hot melt application surface (bottom surface) 23*c* lying between the two regulation ribs 24. The applied hot melt resin needs to protrude from the regulation ribs 24 as illustrated in FIG. 5B, in order that the developing blade 42, when assembled, compresses the hot melt resin so that the hot melt resin securely makes close contact with the developing blade 42 as illustrated in FIG. 5C. With reference to the hot melt application surface 23*c* of the developing container 23, the height of the regulation ribs 24 will be referred to as H1, the height of the hot melt resin after application as H2, and the height of the hot melt resin after the attachment of the developing blade 42 as H3. In other words, H3 is the height of a first surface 42*a* of the developing blade 42 with which the hot melt resin makes contact, i.e., the height of the hot melt resin when functioning as the blade sealing member 53, with reference to the hot melt application surface 23*c* of the developing container 23. The heights H1, H2, and H3 are set to satisfy a relationship of H1<H3<H2, whereby the hot melt resin is ensured to be compressed by the developing blade 42 for close contact.

In the present example embodiment, as illustrated in FIG. 5C, the seal forming portion 23*a* is positioned between the first surface 42*a* where the developing blade 42 makes close contact with the hot melt resin and a second surface 42*b* which is provided to intersect orthogonally with the first surface 42*a*. Since the seal forming portion 23*a* is arranged in a space between the two surfaces of the developing blade 42, the space can be effectively used for miniaturization with the hot melt resin in close contact with the developing blade 42.

As illustrated in FIG. 1, the recess formed by the two regulation ribs 24 includes a straight portion 24*a* provided in a longitudinal center portion and guide portion 24*b* provided at both longitudinal (Z-direction) ends. In the straight portion 24*a*, the two regulation ribs 24 extend longitudinally in parallel at a constant distance from each other. Assume that a reference line extends longitudinally through a center, in a width direction (Y direction, orthogonal direction) orthogonal to the longitudinal direction, between the two regulation ribs 24 in the straight portion 24*a*. FIG. 7 illustrates the guide portion 24*b* at one longitudinal end. As illustrated in FIG. 7, a tilted surface 24*c* of the regulation rib 24 on one side of the reference line extends along a straight line that extends from a starting point Q on the reference line at an acute angle to the reference line. Similarly, in the guide portion 24*b* at the one longitudinal end, a tilted surface 24*c* of the regulation rib 24 on the other side of the reference line extends along a straight line that extends from the starting point Q on the reference line at an acute angle to the reference line. The two tilted surfaces 24*c* opposed with the reference line therebetween are thus configured to extend along the straight lines that extend from the same starting point Q at an acute angle to the reference line, and so that the width of the guide portion 24*b* increases from the longitudinal center portion to the longitudinal end.

In other words, the seal forming portion 23*a* includes the recess extending from the center portion to both ends in the longitudinal direction of the developing roller 32 and is recessed in a direction away from the developing blade 42. In both longitudinal end portions of the recess, the transverse width of the recess increases gradually with increasing distance from the center portion in the longitudinal direction. As employed herein, the transverse direction refers to a direction perpendicular to the longitudinal direction of the developing roller 32. The recess has a bottom surface and side surfaces. The side surfaces are tilted so as to increase the width with increasing distance from the bottom surface in a direction perpendicular to the bottom surface.

If the hot melt resin is ejected into the seal forming portion 23*a*, the hot melt resin flowing in the Z direction of FIG. 7 (direction from the end to the center portion in the longitudinal direction) comes into contact with the wall surfaces of the guide portion 24*b* and reaction force occurs. In the present example embodiment, the two tilted surfaces 24*c* constituting the guide portion 24*b* are surfaces extending in the directions that form an acute angle to the reference line at the same starting point Q. The widthwise (Y-direction) components of the reaction force that the hot melt resin receives from the two tilted surfaces 24*c* can thus be cancelled out. This can suppress flowing of the applied hot melt resin to one side in the width direction, and suppress running of the hot melt resin outside the seal forming portion 23*a*. In particular, since the two tilted surfaces 24*c* opposing each other constituting the guide portion 24*b* are surfaces extending in the directions that form an angles of θ° to the reference line at the same starting point Q, the widthwise components of the reaction force that the hot melt resin receives from both of the two tilted surfaces 24*c* can be more favorably cancelled out.

In the present example embodiment, the guide portion 24*b* is formed to satisfy a relationship of V>W/2 (FIG. 7), where W is the width of the flow channel 23*b* of the seal forming portion 23*a* in the Y direction, V is the width as much as which the tilted surfaces 24*c* spread out in the width direction in extending from the end on the longitudinal center portion side to the end on the outer side. The amount of tilt of the guide portion 24*b* is thus configured to fall within the distance W/2 from the centerline (reference line) of the flow channel 23*b* to each regulation ribs 24. The blade sealing member 53 formed thus can more reliably seal the gap between the developing container 23 and the developing blade 42 and suppress running of the hot melt resin.

As illustrated in FIG. 8, the flow channel 23*b* is configured so as to increase the distance between the wall surfaces opposed in the width direction with increasing distance from the hot melt application surface 23*c* in the direction in which the regulation ribs 24 protrude from the hot melt application surface 23*c*. More specifically, the wall surfaces of the flow channel 23*b* opposed in the width direction are each formed to tilt with respect to the hot melt application surface 23*c* so that its normal is not directed toward the hot melt application surface 23*c*. The wall surfaces of the flow channel 23*b* opposed in the width direction include the tilted surfaces 24*c*. Such a configuration increases the area of contact of the hot melt resin with the developing container 23 for improved adhesion strength. This can suppress the occurrence of a gap because the hot melt resin is pulled and peeled by an operation for adjusting the position of the developing blade 42, for example, when the developing blade 42 is assembled after the application of the hot melt resin. The hot melt resin is applied to the seal forming portion 23*a* in the X direction of FIG. 8 (downward in the gravitational direction), and the hot melt resin receives reaction force from the two wall surfaces opposed in the width direction. However, the present configuration cancel out the Y-direction components of the reaction force received from the respective wall surfaces. This can suppress running of the hot melt resin outside the seal forming portion.

As described above, in the present example embodiment, the two tilted surfaces 24*c* constituting the guide portion 24*b* of the seal forming portion 23*a* are configured as surfaces extending in the directions that form an acute angle to the reference line at the same starting point Q. The widthwise components of the reaction force that the hot melt resin receives from the two tilted surfaces 24*c* can thus be cancelled out. The seal forming portion 23*a* is further configured so that the wall surfaces opposed in the width direction are tilted with respect to the hot melt application surface 23*c* and the distance between the opposed wall surfaces increase with increasing distance from the hot melt application surface 23*c*. The widthwise components of the reaction force acting on the hot melt resin from the two wall surfaces when the hot melt resin is ejected can thereby be cancelled out.

By an interaction of such configurations, the configuration according to the present example embodiment can more favorably suppress flowing of the applied hot melt resin to one side in the width direction, and suppress running of the hot melt resin outside the seal forming portion 23*a*. The ejected hot melt resin can stably form the blade sealing member 53 of uniform shape, and the formed blade sealing member 53 can more reliably seal the gap between the developing container 23 and the developing blade 42 to suppress toner leakage. The configuration according to the present example embodiment can provide the blade sealing member 53 having stable sealing performance even if the blade sealing member 53 is reduced in size.

Functions, materials, shapes, and relative arrangement of the components described in the present example embodiment are not intended to limit the scope of the disclosure thereto unless otherwise specified.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2017-193780, filed Oct. 3, 2017, which is hereby incorporated by reference herein in its entirety.

What is claimed is:

1. A developing device comprising:

a rotatable developer bearing member configured to bear developer on a surface thereof;

a regulation member configured to regulate a thickness of the developer borne on the surface of the developer bearing member, one end of the regulation member in a direction orthogonal to a rotation axis direction of the developer bearing member being in contact with the surface of the developer bearing member;

a frame configured to support the developer bearing member, the other end of the regulation member in the orthogonal direction being fixed to the frame, the frame including a recess in an opposed surface opposed to the regulation member, the recess being recessed in a direction away from the regulation member and extending from a center portion toward both end portions in the rotation axis direction, a width, in the orthogonal direction, of the recess at both the end portions increasing gradually as distance from the center portion in the rotation axis direction increases; and a sealing member provided in the recess to seal a gap between the regulation member and the frame, the sealing member being formed by ejecting thermally melted resin into the recess.

2. The developing device according to claim 1, wherein the recess has a bottom surface and side surfaces, the side surfaces being tilted so that the width increases as distance from the bottom surface in a direction perpendicular to the bottom surface increases.

3. The developing device according to claim 1, wherein the recess is formed by two ribs and a bottom surface, the two ribs protruding from the opposed surface in a direction toward the regulation member and extending in the rotation axis direction with a space therebetween, the bottom surface being part of the opposed surface between the two ribs.

4. The developing device according to claim 1, wherein the sealing member is formed of thermoplastic elastomer resin.

5. The developing device according to claim 1, wherein the sealing member is formed by ejecting the thermally melted resin into the recess successively in the rotation axis direction with one of the end portions of the recess as a starting point and the other as an end point.

6. A frame used in a developing device including a rotatable developer bearing member configured to bear developer on a surface thereof, and a regulation member configured to regulate a thickness of the developer borne on the surface of the developer bearing member, one end of the regulation member in a direction orthogonal to a rotation axis direction of the developer bearing member being in contact with the surface of the developer bearing member, the frame comprising:

a recess in an opposed surface opposed to the regulation member, the recess being recessed in a direction away from the regulation member and extending from a center portion to both end portions in the rotation axis direction, a width, in the orthogonal direction, of the recess in both the end portions increasing gradually as distance from the center portion in the rotation axis direction increases; and a sealing member formed by ejecting thermally melted resin into the recess, the sealing member being configured to seal a gap between the regulation member and the frame.

7. The frame according to claim 6, wherein the recess has a bottom surface and side surfaces, the side surfaces being tilted so that the width increases as distance from the bottom surface in a direction perpendicular to the bottom surface increases.

8. The frame according to claim 6, wherein the recess is formed by two ribs and a bottom surface, the two ribs protruding from the opposed surface in a direction toward the regulation member and extending in the rotation axis direction with a space therebetween, the bottom surface being part of the opposed surface between the two ribs.

9. The frame according to claim 6, wherein the sealing member is formed of thermoplastic elastomer resin.

10. The frame according to claim 6, wherein the sealing member is formed by ejecting the thermally melted resin into the recess successively in the rotation axis direction with one of the end portions of the recess as a starting point and the other as an end point.

* * * * *